US005894945A

United States Patent [19]

Curran

[11] Patent Number: 5,894,945

[45] Date of Patent: Apr. 20, 1999

[54] MULTIPLE DOOR PAINT RACK SYSTEM

[76] Inventor: William F. Curran, 22 Armstrong Cir., Braintree, Mass. 02184

[21] Appl. No.: 08/812,339

[22] Filed: Mar. 5, 1997

[51] Int. Cl.[6] ..... A47F 5/10

[52] U.S. Cl. ..... 211/162; 211/206

[58] Field of Search ..... 211/162, 206, 211/204

[56] References Cited

U.S. PATENT DOCUMENTS

| | | | |
|---|---|---|---|
| 1,462,803 | 7/1923 | Deserty | 211/162 |
| 2,460,997 | 2/1949 | Myers | 211/162 |
| 2,782,846 | 2/1957 | Bussard | 211/162 |
| 3,985,183 | 10/1976 | Fernbaugh | 211/162 |
| 5,617,962 | 4/1997 | Chen | 211/206 |

*Primary Examiner*—Daniel P. Stodola
*Assistant Examiner*—Vestan B. Booth

[57] ABSTRACT

A new multiple door paint rack system for consolidating doors and shutters for spray painting and storing in an organized assembly includes an elongated base member, a first support member secured vertically to one end of the base member, a second support member secured vertically to the opposite end, a cross beam slidably secured between the support members by an adjustable securing pin vertically adjustable, and a sliding swivel support assembly slidably secured to the elongated base member and the cross beam.

11 Claims, 3 Drawing Sheets

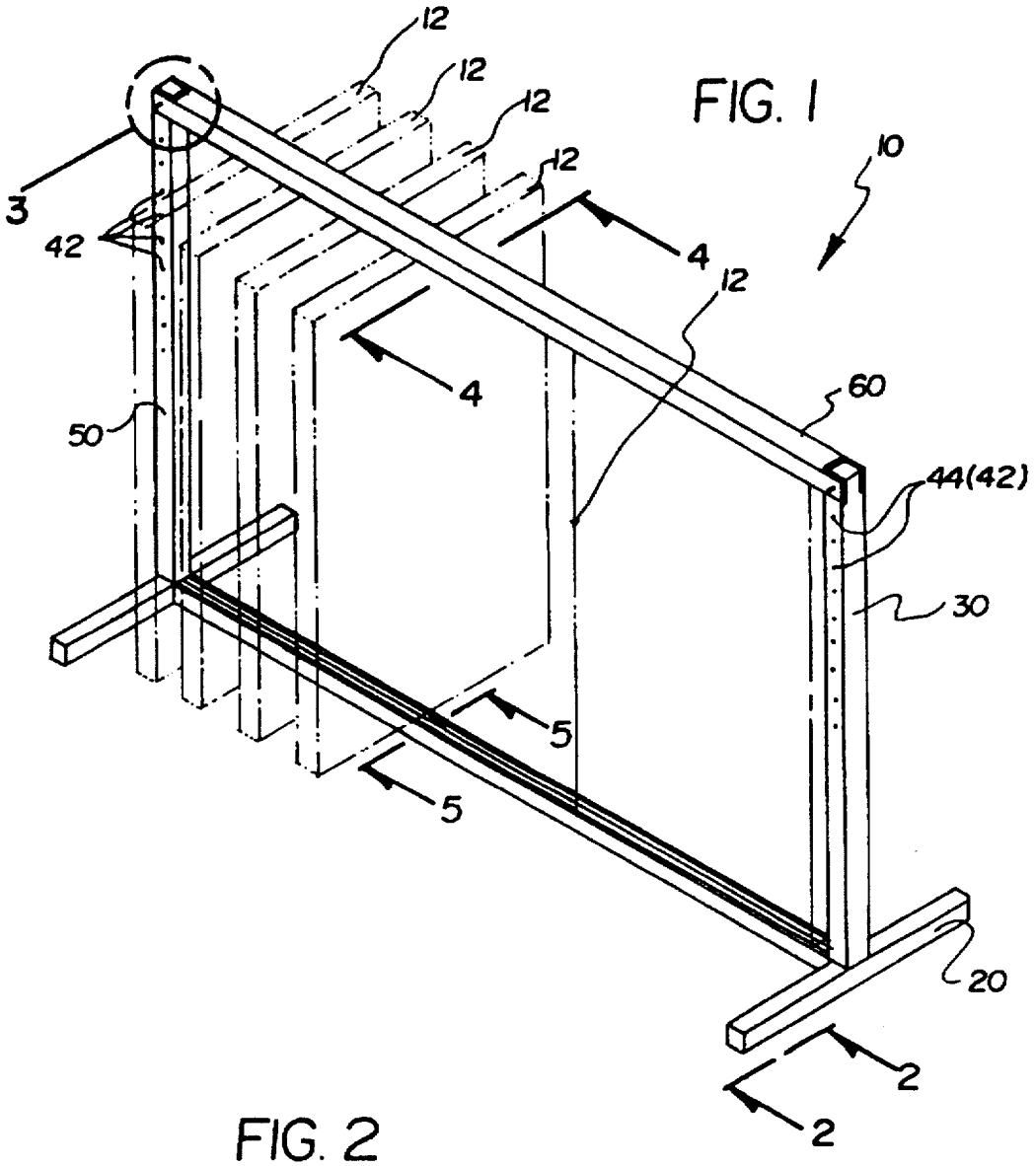
FIG. 2
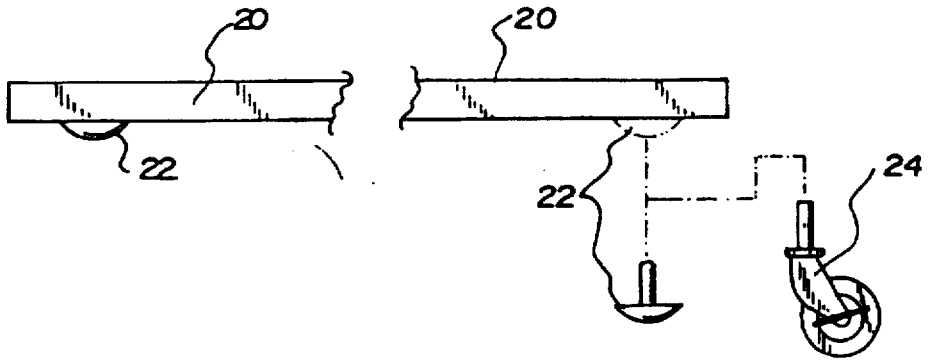

MULTIPLE DOOR PAINT RACK SYSTEM

BACKGROUND OF THE INVENTION

1. Field of the Invention

The present invention relates to Door Painting Devices and more particularly pertains to a new multiple door paint rack system for consolidating doors and shutters for spray painting and storing in an organized assembly.

2. Description of the Prior Art

The use of Door Painting Devices is known in the prior art. More specifically, Door Painting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Door Painting Devices include U.S. Pat. No. 5,164,011; U.S. Pat. No. 4,278,244; U.S. Pat. No. 3,861,662; U.S. Pat. No. 3,071,253; U.S. Pat. No. 4,193,375 and U.S. Pat. No. 3,643,935.

While these devices fulfill their respective, particular objectives and requirements, the aforementioned patents do not disclose a new multiple door paint rack system. The inventive device includes an elongated base member, a first support member secured vertically to one end of the base member, a second support member secured vertically to the opposite end, a cross beam slidably secured between the support members by an adjustable securing means vertically adjustable, and a sliding swivel support means slidably secured to the elongated base member and the cross beam.

In these respects, the multiple door paint rack system according to the present invention substantially departs from the conventional concepts and designs of the prior art, and in so doing provides an apparatus primarily developed for the purpose of consolidating doors and shutters for spray painting and storing in an organized assembly.

SUMMARY OF THE INVENTION

In view of the foregoing disadvantages inherent in the known types of Door Painting Devices now present in the prior art, the present invention provides a new multiple door paint rack system construction wherein the same can be utilized for consolidating doors and shutters for spray painting and storing in an organized assembly.

The general purpose of the present invention, which will be described subsequently in greater detail, is to provide a new multiple door paint rack system apparatus and method which has many of the advantages of the Door Painting Devices mentioned heretofore and many novel features that result in a new multiple door paint rack system which is not anticipated, rendered obvious, suggested, or even implied by any of the prior art Door Painting Devices, either alone or in any combination thereof.

To attain this, the present invention generally comprises an elongated base member, a first support member secured vertically to one end of the base member, a second support member secured vertically to the opposite end, a cross beam slidably secured between the support members by an adjustable securing means vertically adjustable, and a sliding swivel support means slidably secured to the elongated base member and the cross beam.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple door paint rack system apparatus and method which has many of the advantages of the Door Painting Devices mentioned heretofore and many novel features that result in a new multiple door paint rack system which is not anticipated, rendered obvious, suggested, or even implied by any of the prior art Door Painting Devices, either alone or in any combination thereof.

It is another object of the present invention to provide a new multiple door paint rack system which may be easily and efficiently manufactured and marketed.

It is a further object of the present invention to provide a new multiple door paint rack system which is of a durable and reliable construction.

An even further object of the present invention is to provide a new multiple door paint rack system which is susceptible of a low cost of manufacture with regard to both materials and labor, and which accordingly is then susceptible of low prices of sale to the consuming public, thereby making such multiple door paint rack system economically available to the buying public.

Still yet another object of the present invention is to provide a new multiple door paint rack system which provides in the apparatuses and methods of the prior art some of the advantages thereof, while simultaneously overcoming some of the disadvantages normally associated therewith.

Still another object of the present invention is to provide a new multiple door paint rack system for consolidating doors and shutters for spray painting and storing in an organized assembly.

Yet another object of the present invention is to provide a new multiple door paint rack system which includes an elongated base member, a first support member secured vertically to one end of the base member, a second support member secured vertically to the opposite end, a cross beam slidably secured between the support members by an adjustable securing means vertically adjustable, and a sliding swivel support means slidably secured to the elongated base member and the cross beam.

Still yet another object of the present invention is to provide a new multiple door paint rack system that can be disassembled quickly to transport to and from a job site, or for storage.

Even still another object of the present invention is to provide a new multiple door paint rack system that decreases the painting time while providing a superior finish.

Another object of the present invention is to support a plurality of doors or shutter pivotally and slidably along the elongated base member and the cross beam.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper side perspective view of a new multiple door paint rack system according to the present invention.

FIG. 2 is a cross sectional view taken along line 2—2 of FIG. 1.

DESCRIPTION OF THE PREFERRED EMBODIMENT

Figure 3:
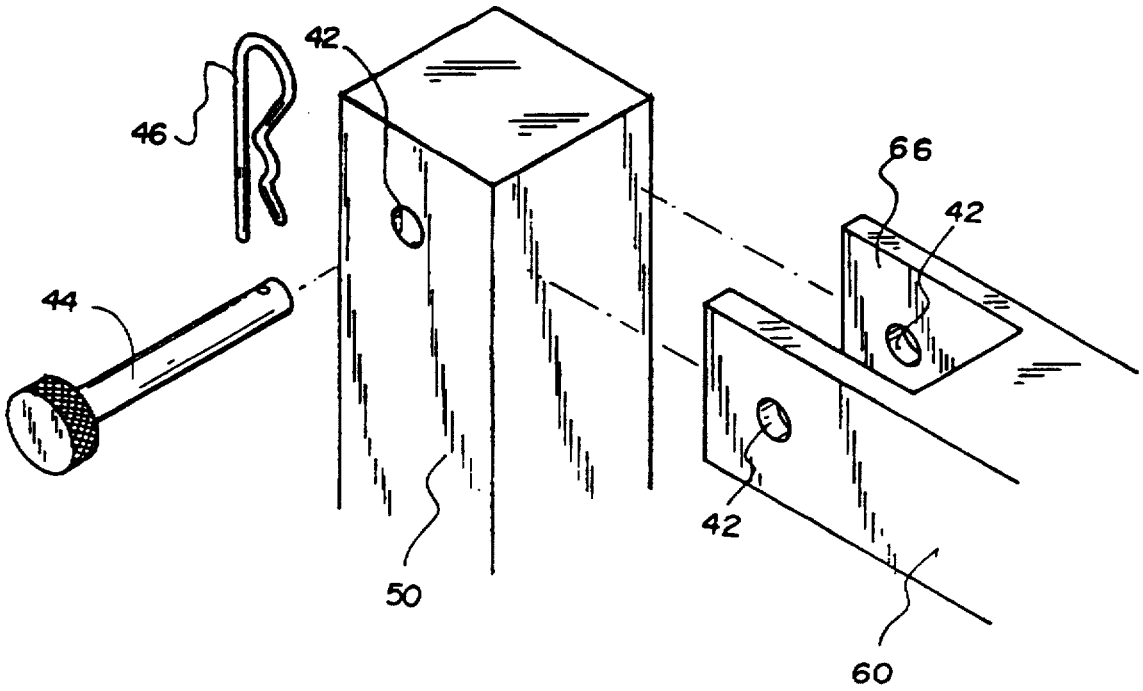
FIG. 3 is an exploded isometric illustration of the present invention from FIG. 1.

With reference now to the drawings, and in particular to FIGS. 1 through 6 thereof, a new multiple door paint rack system embodying the principles and concepts of the present invention and generally designated by the reference numeral 10 will be described.

More specifically, it will be noted that the Multi-Paint Rack System 10 comprises an elongated base member 20, a first support member 30 vertically secured to an end of the elongated base member 20, a second support member 50 vertically secured to an end of the elongated base member 20 opposite of the first support member 30, a cross beam 60 adjustably secured between the first support member 30 and the second support member 50 by an adjustable securing means 40, and a sliding swivel support means 70 attached along the bottom portion of the cross beam 60, where the sliding swivel support means 70 vertically supports a plurality of objects 12 to be painted allowing the objects 12 to be pivoted and slidably positioned in relation to one another.

Figure 4:
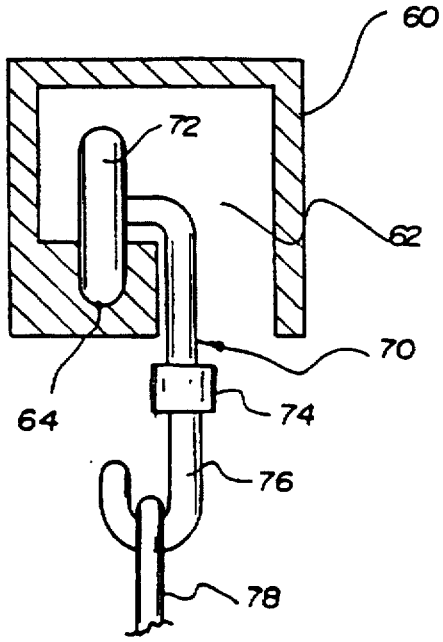
FIG. 4 is a cross sectional view taken along line 4—4 of FIG. 1.
Figure 5:
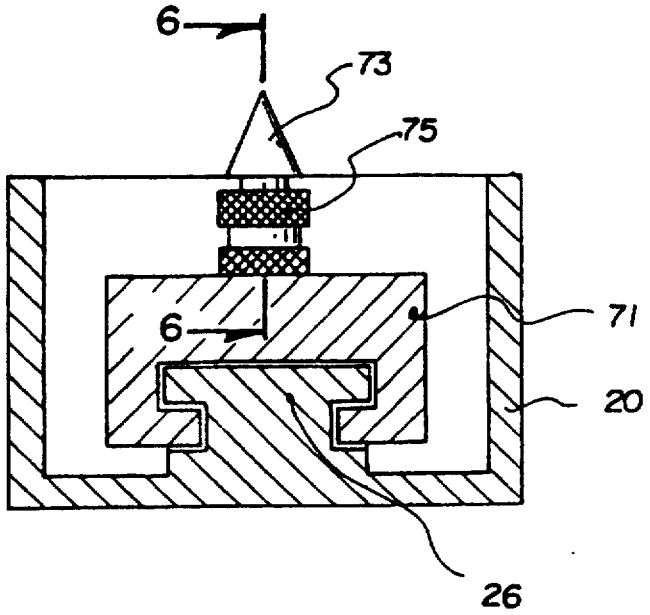
FIG. 5 is a cross sectional view taken along line 5—5 of FIG. 1.
Figure 6:
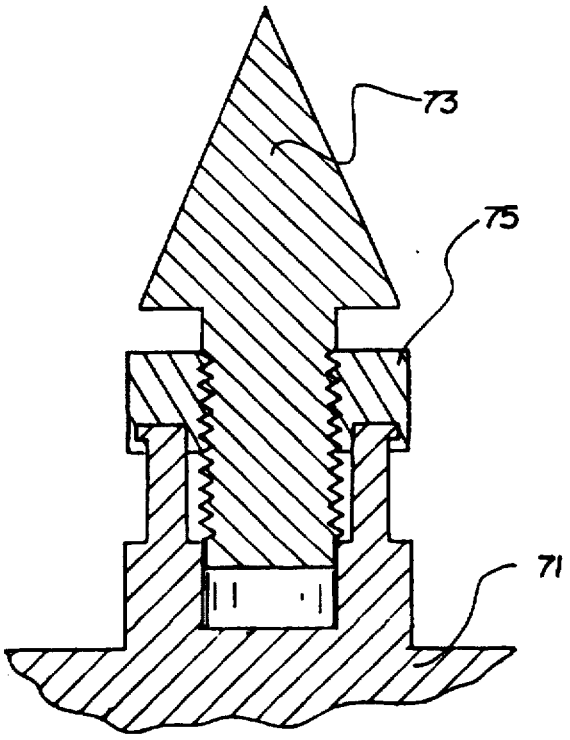
FIG. 6 is a cross sectional view taken along line 6—6 of FIG. 5.

As best illustrated in FIGS. 4 through 6, it can be shown that the cross beam 60 including an inverted L-slot 62 and a guide slot 64 into the upper ledge portion of the L-slot 62. A plurality of rollers 72 are positioned within the guide slot 64 as shown in FIG. 4. A swivel member 74 is rotatably secured to each roller 72 and extends downwardly through the L-slot 62 thereafter pivotally secures a J-hook 76. As shown in FIG. 4, the J-hook 76 engages a support hook 78 secured to the cornice of the object 12 to be painted. As shown in FIG. 5, an I-shaped track 26 is secured to the cornice of the elongated base member 20. A plurality of track runners 71 which are substantially cuff shaped slidably engage the I-shaped track 26. A swivel pin 73 has a pointed end and a threaded end. The threaded end threadably secures within the cornice of the track runner 71 allowing vertical adjustment of the swivel pin 73. A locking collar 75 threadably surrounds and engages the threaded end of the swivel pin 73 and rotatably engages the track runner 71 allowing locking into position of the swivel pin 73 as best shown in FIG. 6 of the drawings.

As shown in FIGS. 1 and 3, the cross beam 60 has both ends having a U-shaped end 66 with a locking aperture 42 which slidably engage the first support member 30 and the second support member 50. The first support member 30 and second support member 50 having a plurality of corresponding locking apertures 42 which receive a locking pin 44 which projects through the locking aperture 42 of the U-shaped end 66. The elongated base member 20 preferably has a plurality of support nubs 22 or caster wheels 24 secured to the bottom surface.

In use, the object 12, such as a door or a shutter, is vertically positioned within the present invention with the support hook 78 projecting outwardly from the cornice. The J-hook 76 removably engages the support hook 78 thereby pivotally supporting the object 12. The swivel pin 73 is vertically adjusted to engage the bottom edge of the object 12, thereby allowing the object 12 to pivot about the swivel pin 73. The above process is repeated for each object 12 to be painted. The objects 12 are positioned transversely to the front plane of the invention thereby allowing numerous objects 12 to be stored during and after painting. One object 12 is selectively positioned a finite distance from the grouped objects 12. The object 12 is thereafter pivoted to be substantially parallel to the front plane of the invention. After painting the object 12, the object is positioned transversely to the front plane of the invention opposite of the group of objects 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multiple door paint rack system comprising:

an elongated base member;

a first support member vertically secured to an end of said elongated base member;

a second support member vertically secured to an end of said elongated base member opposite of said first support member;

a cross beam adjustably secured between said first support member and said second support member; and a sliding swivel support means attached along the bottom portion of said cross beam, where said sliding swivel support means vertically supports a plurality of objects to be painted allowing said objects to be pivoted and slidably positioned in relation to one another;

said cross beam with both ends having a U-shaped end with a locking aperture which slidably engage said first support member and said second support member;

said first support member and second support member having a plurality of corresponding locking apertures which receive a locking pin which projects through said locking aperture of said U-shaped end.

2. The multiple door paint rack system of claim 1, wherein said sliding swivel support means comprises:

said cross beam including an inverted L-slot and a guide slot into the upper ledge portion of said L-slot;

a plurality of rollers positioned within said guide slot; and a swivel member rotatably secured to said roller and extending downwardly through said L-slot thereafter pivotally securing a J-hook, wherein said J-hook engages a support hook secured to an upper surface of said object to be painted.

3. The multiple door paint rack system of claim 1 wherein said sliding swivel support means further includes:

an I-shaped track secured to an upper surface of said elongated base member;

a plurality of track runners substantially cuff shaped slidably engaging said I-shaped track;

a swivel pin having a pointed end and a threaded end, said threaded end threadably securing within an upper surface of said track runner allowing vertical adjustment of said swivel pin; and a locking collar threadably surrounding and engaging said threaded end and rotatably engaging said track runner allowing locking into position of said swivel pin.

4. The multiple door paint rack system of claim 1 wherein said elongated base member includes a plurality of caster wheels providing mobility of said elongated base member relative to a floor.

5. The multiple door paint rack system of claim 1 wherein said elongated base member includes a plurality of support nubs secured to the bottom surface.

6. A multiple door paint rack system comprising:

an elongated base member;

a first support member orthogonally secured to an end of said elongated base member;

a second support member orthogonally secured to an end of said elongated base member opposite of said first support member;

a cross beam adjustably secured between said first support member and said second support member by an adjustable securing means; and a sliding swivel support means attached along the bottom portion of said cross beam, where said sliding swivel support means vertically supports a plurality of objects to be painted allowing said objects to be pivoted and slidably positioned in relation to one another;

wherein said sliding swivel support means comprises:

said cross beam including an inverted L-slot and a guide slot into the upper ledge portion of said L-slot;

a plurality of rollers positioned within said guide slot; and a swivel member rotatably secured to said roller and extending downwardly through said L-slot thereafter pivotally securing a J-hook, where said J-hook engages a support hook secured to an upper surface of said object to be painted.

7. The multiple door paint rack system of claim 6, wherein said sliding swivel support means further includes:

an I-shaped track secured to an upper surface of said elongated base member;

a plurality of track runners substantially cuff shaped slidably engaging said I-shaped track;

a swivel pin having a pointed end and a threaded end, said threaded end threadably securing within an upper surface of said track runner allowing vertical adjustments of said swivel pin; and a locking collar threadably surrounding and engaging said threaded end and rotatably engaging said track runner allowing locking into position of said swivel pin.

8. The multiple door paint rack system of claim 7, wherein said adjustable securing means includes:

said cross beam with both ends having a U-shaped end with a locking aperture which slidably engage said first support member and said second support member; and said first support member and second support member having a plurality of corresponding locking apertures which receive a locking pin which projects through said locking aperture of said U-shaped end.

9. The multiple door paint rack system of claim 8, wherein said elongated base member includes a plurality of support nubs secured to the bottom surface.

10. The multiple door paint rack system of claim 8, wherein said elongated base member includes a plurality of caster wheels providing mobility of said elongated base member relative to a floor.

11. A multiple door paint rack system comprising:

an elongated base member;

a first support member vertically secured to an end of said elongated base member;

a second support member vertically secured to an end of said elongated base member opposite of said first support member;

a cross beam adjustably secured between said first support member and said second support member by an adjustable securing means; and a sliding swivel support means attached along the bottom portion of said cross beam, where said sliding swivel support means vertically supports a plurality of objects to be painted allowing said objects to be pivoted and slidably positioned in relation to one another;

wherein said sliding swivel support means comprises:

said cross beam including an inverted L-slot and a guide slot into the upper ledge portion of said L-slot;

a plurality of rollers positioned within said guide slot; and a swivel member rotatably secured to said roller and extending downwardly through said L-slot thereafter pivotally securing a J-hook, wherein said J-hook engages a support hook secured to an upper surface of said object to be painted;

wherein said sliding swivel support means further includes:

an I-shaped track secured to an upper surface of said elongated base member;

a plurality of track runners substantially cuff shaped slidably engaging said I-shaped track;

a swivel pin having an pointed end and a threaded end, said threaded end threadably securing within an upper surface of said track runner allowing vertical adjustment of said swivel pin; and a locking collar threadably surrounding and engaging said threaded end and rotatably engaging said track runner allowing locking into position of said swivel pin;

wherein said adjustable securing means includes:

said cross beam with both ends having a U-shaped end with a locking aperture which slidably engage said first support member and said second support member; and said first support member and second support member having a plurality of corresponding locking apertures which receive a locking pin which projects through said locking aperture of said U-shaped end;

wherein said elongated base member includes a plurality of support nubs secured to the bottom surface; and wherein said elongated base member includes a plurality of caster wheels providing mobility of said elongated base member relative to a floor.

* * * * *